United States Patent [19]

Aboelfotoh

[11] Patent Number: 4,475,060

[45] Date of Patent: Oct. 2, 1984

[54] STABILIZED PLASMA DISPLAY DEVICE

[75] Inventor: Mohamed O. Aboelfotoh, Poughkeepsie, N.Y.

[73] Assignee: International Business Machines, Armonk, N.Y.

[21] Appl. No.: 260,578

[22] Filed: May 5, 1981

[51] Int. Cl.[3] ..... H01J 61/35

[52] U.S. Cl. ..... 313/587

[58] Field of Search ..... 313/221, 586, 587

[56] References Cited

U.S. PATENT DOCUMENTS

| | | | |
|---|---|---|---|
| 3,863,089 | 1/1975 | Ernsthausen et al. | 313/221 X |
| 3,996,489 | 12/1976 | Byrum, Jr. et al. | 313/221 X |
| 4,053,804 | 10/1977 | Aboelfotoh | 313/218 |
| 4,114,064 | 9/1978 | Ernsthausen | 313/221 X |
| 4,207,488 | 6/1980 | Aboelfotoh | 313/221 |

FOREIGN PATENT DOCUMENTS 263 1/1979 European Pat. Off. .

*Primary Examiner*—Palmer C. Demeo

*Attorney, Agent, or Firm*—Joseph J. Connerton

[57] ABSTRACT

A high resolution gaseous discharge display and/or memory device comprises a panel array of bistable charge storage areas designated gaseous discharge cells or sites, each cell having an associated pair of coordinate orthogonal conductors defining the cell walls which, when appropriately energized, produce a confined gaseous discharge in the selected sites. The conductors are insulated from direct contact with the gas by a dielectric insulator composed of a layer of Group IIA oxide doped with a beneficial amount of one or more transition elements selected from nickel, iron, chromium or manganese, to stabilize and control the secondary-electron emission characteristics of the Group IIA oxide under ion bombardment, to eliminate the decrease in the maximum sustain voltage and the bistable voltage margin of the panel during panel operation and to increase initially the bistable voltage margin of the panel, thereby providing stable operating voltages and extending the life of the gaseous discharge display panel. In a preferred embodiment of the invention, the dielectric insulator comprises magnesium oxide doped with 3–5 percent nickel by weight.

3 Claims, 2 Drawing Figures

STABILIZED PLASMA DISPLAY DEVICE

CROSS REFERENCE TO RELATED APPLICATIONS

U.S. application Ser. No. 405,205 for "Gas Panel Fabrication" filed by Peter H. Haberland et al Sept. 24, 1974, now U.S. Pat. No. 3,837,724.

U.S. application Ser. No. 372,384 for "Improved Method and Apparatus for a Gas Display Panel" filed by Tony N. Criscimagna et al June 21, 1973.

U.S. application Ser. No. 841,186 for "Improved Gas Panel Spacer" filed by Charles H. Perry Oct. 11, 1977.

U.S application Ser. No. 736,802 for "Method of Manufacturing A Gas Panel Assembly" filed by M. O. Aboelfotoh et al Oct. 29, 1976, now U.S. Pat. No. 4,083,614.

BACKGROUND OF THE INVENTION

Plasma or gaseous discharge display and/or storage apparatus have certain desirable characteristics such as small size, a thin flat display package, relatively low power requirements and inherent memory capability which render them particularly suitable for display apparatus. One example of such known gaseous discharge devices is disclosed in U.S. Pat. No. 3,559,190, "Gaseous Display and Memory Apparatus," patented Jan. 26, 1971 by Donald L. Bitzer et al. Such devices, designated A.C. gas or plasma panels, may include an inner glass layer of physically isolated gas cells or comprise an open panel configuration of electrically insulated but not physically isolated gas cells. In the open panel configuration which represents the preferred embodiment of the instant invention, a pair of glass plates having dielectrically coated conductor arrays formed thereon are sealed with the conductors disposed in substantially orthogonal relationship. Appropriate drive signals are applied to selected groups of conductors, and capacitively coupled to the gas through the dielectric. When these signals exceed the breakdown voltage of the gas, the gas discharges in the selected cell area, and the resulting charge particles, ions and electrons, are attracted to the wall having a potential opposite the polarity of the particle. This resulting wall charge potential opposes the drive signals which produce and maintain the discharge, rapidly extinguishing the discharge and assisting the breakdown in the next sustain signal alternation. Each discharge produces light emission from the selected cell or cells, and by operating at a relatively high frequency in the order of 30–40 kilocycles, a flicker-free display is provided. After initial breakdown, the wall charge condition is maintained in selected cells by application of a lower potential designated the sustain signal which, combined with the wall charge, causes the selected cells to be reignited and extinguished continuously at the applied frequency to maintain a continuous display.

The capacitance of the dielectric layer is determined by the thickness of the layer, the dielectric constant of the material and the geometry of the associated drive conductors. The dielectric material must be an insulator having sufficient dielectric strength to withstand the voltage produced by the wall charge and the externally applied potential. The dielectric should be a relatively good emitter of secondary electrons to assist in maintaining the discharge, be transparent or translucent on the display side to transmit the light generated by the discharge for display purposes, and be susceptible to fabrication without reacting with the conductor metallurgy. Finally, the coefficient of expansion of the dielectric must be compatible with that of the glass plate or substrate on which the dielectric layer is formed.

One material possessing the above characteristics with respect to a soda-lime-silica substrate is lead-borosilicate solder glass, a glass containing in excess of 75 percent lead oxide. In an embodiment constructed in accordance with the teaching of the present invention, a dielectric comprising a layer of lead-borosilicate glass was employed as the insulator. However, degradation or decomposition of the lead oxide at the dielectric surface under the discharge environment produced variations in the electrical characteristics of the gaseous discharge display panel on a cell-by-cell basis. This degradation, resulting primarily from ion bombardment of the dielectric surface, caused the electrical parameters of the individual cells in the gaseous discharge device to vary as a function of the cell history such that over a period of time, the required firing voltage for individual cells fell outside the normal operating range, and the firing voltage varied on a cell-by-cell basis.

In order to avoid degradation of the dielectric surface resulting from ion bombardment in a gaseous discharge device, a refractory high secondary electron emissive material such as magnesium oxide (MgO) is utilized to protect the dielectric surface. The refractory aspect prevents sputtering of the dielectric by ion bombardment, while the high secondary-electron emission aspect permits lower operating voltages. It is known in the art that the breakdown voltage in a gaseous discharge device may be lowered by utilizing a material having a high secondary-electron emission coefficient such as MgO. However, changes in the surface properties, namely the secondary-electron emission coefficient of MgO produced by ion bombardment during the discharge, caused the maximum sustain voltage and the bistable voltage margin of the panel, i.e., the difference between the maximum sustain voltage ($V_s$max) and minimum sustain voltage ($V_s$min) required to sustain the lines in the panel, to decrease significantly with panel operating time. During normal panel operation, the maximum and minimum sustain voltages defining the bistable voltage margin of the panel tended to converge over a period of time, effectively reducing the operating margin of the panel below acceptable limits, resulting in reduction of the yield of the panels thus fabricated, thereby significantly raising the panel cost.

SUMMARY OF THE INVENTION

In accordance with the instant invention, a layer or coating of a refractory material characterized by a high coefficient of secondary-electron emission such as a Group IIA oxide (e.g., magnesium oxide, barium oxide, calcium oxide, strontium oxide, or combinations thereof) is doped with a beneficial amount of one or more transition elements selected from Groups VIII (e.g., nickel or iron), VIIB (e.g., manganese) or VIB (e.g., chromium) and applied over the entire surface of the dielectric layer. The incorporation of such transition elements into the magnesium oxide layer results in virtually eliminating the changes in the surface properties of the refractory overcoat material caused by ion bombardment during the discharge. Normally, continuous ion bombardment in a plasma display device even with a magnesium oxide dielectric overcoat results in changes in the maximum and minimum sustain voltages during operation of the A.C. gas panel over a period of time, a characteristic of the intrinsic aging effect of the panel. In a preferred embodiment of the instant invention using the preferred embodiment of magnesium oxide doped with nickel, the nickel concentration, which has an optimum concentration of 3 to 5 weight percent, results in substantially no change in the maximum and minimum sustain voltages ($V_s$max and $V_s$min) and hence in the bistable voltage margin ($V_s$max$-V_s$min) with panel operating time, thereby extending the usable life of the gas panel. In other words, the normal aging effect of the panel is substantially eliminated. The bistable voltage margin of the cells is increased by increasing $V_s$max at a higher rate than that of $V_s$min, since the secondary-electron emission characteristics of magnesium oxide may be controlled or tuned by the amount of nickel utilized. As the nickel concentration is increased, there is a gradual but progressive lowering of margin such that when the nickel concentration is increased to 10–12 weight percent, the minimum sustain voltage increases at a higher rate than the maximum sustain voltage, resulting in a decrease in the panel bistable voltage margin. By utilizing the preferred embodiment of magnesium oxide doped with an optimal range of 3 to 5 weight percent nickel, the decrease in the maximum sustain voltage and correspondingly in the bistable voltage margin is eliminated, thereby increasing the panel life and lowering the per unit cost.

Accordingly, a primary object of the present invention is to provide an improved gaseous discharge display device having improved life and aging characteristics.

Another object of the present invention is to provide an improved gaseous discharge display panel utilizing a surface of magnesium oxide doped with nickel, iron, manganese, chromium or combination thereof adjacent to and in continuous contact with the gas to improve and/or maintain the bistable voltage margin of the device.

Still another object of the present invention is to provide an improved gaseous discharge display panel having a layer of magnesium oxide which may comprise 3 to 5 weight percent nickel, iron, manganese, chromium or combination thereof in contact with the gas to stabilize the secondary-electron emission characteristics during the discharge, to eliminate the decrease in the bistable voltage margin during operation and thereby extend panel life.

Another object of the instant invention is to provide an improved gas panel assembly adapted to eliminate the intrinsic aging effects exhibited by the undoped magnesium oxide layers, which significantly limit the usable life of the device.

The foregoing and other objects, features and advantages of the present invention will be apparent from the following description of a preferred embodiment of the invention as illustrated in the accompanying drawings.

DESCRIPTION OF A PREFERRED EMBODIMENT

Figure 1:
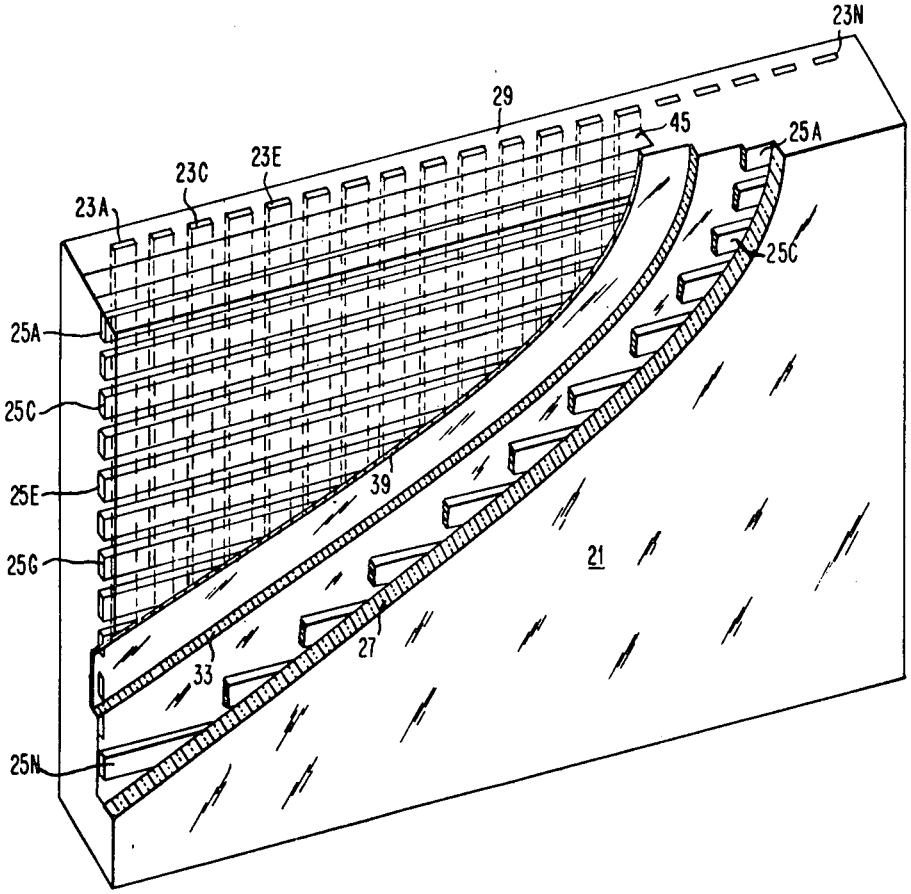
FIG. 1 is an isometric view of a gaseous discharge display panel broken away to illustrate details of the present invention.

Referring now to the drawings and more particularly to FIG. 1 thereof, there is illustrated a gas panel 21 comprising a plurality of individual gas cells or sites defined by the intersections of vertical drive lines 23A–23N and horizontal drive lines 25A–25n. The structure of the preferred embodiment as shown in the drawings is enlarged, although not to scale, for purposes of illustration, however, the physical and electrical parameters of the invention defined in the instant application are fully described in detail hereinafter. While only the viewing portion of the display is illustrated in the interest of clarity, it will be appreciated that in practice the drive conductors extend beyond the viewing area for interconnection to the driving signal source.

The gas panel 21 includes an illuminable gas such as a mixture of neon and argon within a sealed structure, the vertical and horizontal conductor arrays being formed on associated glass plates and disposed in orthogonal relationship on opposite sides of the structure. Gas cells within the panel, defined by conductor intersections, are selectively ionized during a write operation by applying to the associated conductors coincident potentials having a magnitude sufficient to exceed the breakdown voltage $V_b$ of the gas. In the preferred embodiment, the control potentials for write, sustain and erase operations may be square wave A.C. signals of the type described in aforenoted copending application Ser. No. 372,384. Once the gas has been broken down and the wall charge established, the gas cells are maintained in a repetitive discharge state by a lower amplitude periodic sustain signal. Any of the selected cells may be extinguished, termed an erase operation, by neutralizing the wall charge, thereby reducing the potential difference across the cell such that the sustain signal alone is not adequate to maintain the discharge. By selective write operations, information may be generated and displayed as a sequence of lighted cells or sites in the form of alphanumeric or graphic data, and such information may be regenerated as long as desired by the sustain operation.

Figure 2:
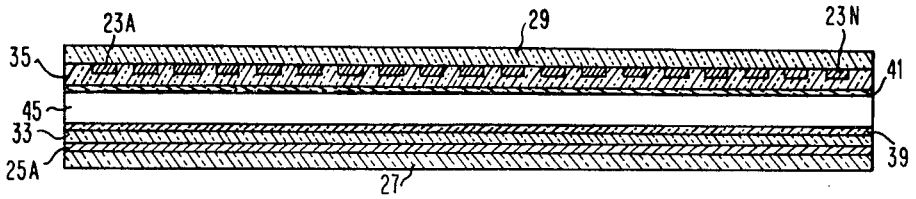
FIG. 2 is a top view of the gaseous discharge display panel illustrated in FIG. 1.

Since the dielectric or its associated overcoat interfaces directly with the gas, it may be considered a gas panel envelope comprising relatively thin sheets of dielectric material such that a pair of glass substrates 27, 29, front and rear, is employed as support members on opposite sides of the panel. The only requirement for such support members is that they be nonconductive and good insulators, and substantially transparent for display purposes. One-fourth inch thick commercial grade soda-lime-silica glass is utilized in the preferred embodiment. Shown also in cutaway is the horizontal conductor array 25 comprising conductors 25A–25N which are interposed between the glass substrate 27 and associated dielectric member 33. The corresponding configuration for vertical conductor array 23 is illustrated in FIG. 2. Conductor arrays 23, 25 may be formed on substrates 27, 29 by a number of well-known processes such as photoetching, vacuum deposition, stencil screening, etc. Transparent, semi-transparent or opaque conductive material such as tin oxide, gold, aluminum or copper can be used to form the conductor arrays, or alternatively the conductor arrays 23, 25 may be wires or filaments of copper, gold, silver or aluminum or any other conductive metal or material. However, formed in situ conductor arrays are preferred, since they are more easily and uniformly deposited on and adhere to the substrates 27, 29. In a preferred embodiment constructed in accordance with the instant invention, opaque chrome-copper-chrome conductors are utilized, the intermediate copper layer serving as the conductor, the lower layer of chromium providing adhesion to the associated substrate, the upper layer of chromium protecting the copper conductor from attack by the lead-borosilicate insulator during fabrication.

In the preferred embodiment herein described, dielectric layers 33, 35, layer 33 of which is broken away in FIG. 1, are formed in situ directly over conductor arrays 25, 23 respectively and comprise an inorganic material having an expansion coefficient closely related to that of the substrate members. One preferred dielectric material, as previously indicated, is commercial lead-borosilicate solder glass, a material containing a high percentage of lead oxide. To fabricate the dielectric, lead-borosilicate glass frit is sprayed over the conductor array and the substrate placed in an oven where the glass frit is reflowed and monitored to ensure appropriate uniformity. Alternatively, the dielectric layer could be formed by electron beam evaporation, chemical vapor deposition or other suitable means. While the basic requirements for the dielectric layer have been specified, additionally the surface of the dielectric layers should be electrically homogeneous on a microscopic scale, i.e., should be preferably free from cracks, bubbles, crystals, dirt, surface films or any impurity or imperfection. For additional details relative to gas panel fabrication, reference is made to the aforenoted U.S. Pat. No. 3,837,724.

Finally, as heretofore described, the problem arising from changes in the surface properties of the dielectric overcoat, primarily the secondary-electron emission characteristics of the magnesium oxide layer produced by ion bombardment caused the maximum sustain voltage and the bistable voltage margin to decrease significantly as a function of time, thereby reducing the usable life of the panel. The solution utilized in the preferred embodiment of the instant invention was the deposition of a homogeneous layer of magnesium oxide doped with a beneficial amount of one or more previously identified transition elements. This homogeneous layer in the preferred embodiment is formed over the entire surface of the lead-borosilicate dielectric layer by co-evaporation of nickel and magnesium oxide in an evaporation system of the type shown in FIG. 2 of the aforenoted U.S. Pat. No. 4,083,614, the respective proportions of the constituents being determined by the respective evaporation rates. Such evaporations take place in the single evacuated chamber during a single pumpdown. As previously described, such a layer may comprise between 3 and 5 weight percent nickel, the layer in the preferred embodiment being 3000 angstroms or 0.3 micron thick. Within this preferred range of nickel concentration, the minimum sustain voltage $V_s$min increases slightly, but the maximum sustain voltage $V_s$max has greater increases as the percentage of nickel increases, since the incorporation of nickel lowers the secondary-electron emission coefficient of magnesium oxide. In a preferred embodiment constructed in accordance with the teaching of the instant invention, the minimum sustain voltage with 5 weight percent nickel concentration in the magnesium oxide was 84 volts; the maximum sustain voltage was 99 volts. Corresponding values for magnesium oxide alone were 80 and 90 volts respectively. In the above-described preferred embodiment, the constituent nickel and magnesium oxide were co-evaporated using two separate electron-guns to provide better control of the relative concentrations of the nickel transition element and the Group IIA oxide comprising the overcoat layer.

The breakdown voltage in a gaseous discharge display panel is determined inter alia by the electron amplification in the gas volume defined by the gas ionization coefficient $\alpha$ and the production of secondary-electrons at the confining dielectric surfaces or cell walls defined by the coefficient $\gamma$. For a specified gas mixture, pressure and electrode spacing or discharge gap, $\alpha$ is a monotonically increasing function of the voltage in the ordinary range of panel operation. The secondary-electron emission coefficient is designated by a coefficient $\gamma$, which is a function of the overcoat material and the preparation conditions of the overcoat layer. A self-sustained discharge occurs when the following approximate-relationship is satisfied:

$$\gamma e^{\alpha d} \approx 1$$

where d is the spacing between electrodes or the gas gap.

Consideration of the above equation shows that increases in $\gamma$ will result in a lower breakdown of panel operating voltage $V_b$. $V_s$max is a function of $\gamma$, while $V_s$min is primarily determined by wall charge. Thus, the incorporation of nickel, iron, manganese or chromium at a concentration range from 3 to 5 weight percent into the magnesium oxide increases $V_s$max at a relatively high rate, while $V_s$min remains essentially constant or increases at a slower rate to provide initially increased bistable voltage margin. In a gas panel constructed in accordance with the teaching of the instant invention having a magnesium oxide layer comprising 3 to 5 weight percent nickel, the panel tested indicated a relative percentage change in $V_s$max defined by the equation $$[(V_s\max(0) - V_s\max(t))/V_s\max(0)]$$

where $V_s$max(t) is the value of $V_s$max at time t, and $V_s$max(0) is the corresponding value at t=0, was less than 0.6 percent after 3,000 hours of panel operation. The fabrication process of the panel involved the evaporative co-deposition of nickel and magnesium oxide on panel plates at room temperature. The relative percentage change in $V_s$max indicated by a magnesium oxide coated plate tested under identical conditions was about 2.5 percent, a substantial difference in terms of the nominal values of the margin.

Referring now to FIG. 2, a top view is employed to clarify certain details of the instant invention, particularly since only a portion of the panel is shown in cutaway in FIG. 1. Again, it should be understood that the drawing is not to scale. Two rigid support members or glass substrates 27 and 29 comprise the exterior members of the display panel, and in the preferred embodiment comprise one-fourth inch commercial grade soda-lime-silica glass. Formed on the inner walls of the substrate member 27 and 29 are the horizontal and vertical conductor arrays 25, 23, respectively. The conductor sizes and spacing as illustrated are obviously enlarged in the interest of clarity.

In a typical gas panel configuration, the center-to-center conductor spacing in the respective horizontal and vertical conductor arrays may vary, depending on resolution, between 14 and 60 mils using 3–6 mil wide conductors, which may be typically 2.5 microns in thickness. Formed directly over the conductor arrays 25, 23 are the dielectric layers 33 and 35 respectively which, as previously described, may comprise solder glass such as lead-borosilicate glass containing a high percentage of lead oxide. The dielectric members, being of nonconductive glass, function as insulators and capacitors for their associated conductor arrays. Lead-borosilicate glass dielectric is preferred since it adheres well to other glasses, has a lower reflow temperature than the soda-lime-silica glass substrates on which it is laid, and has a relatively high viscosity with a minimum of interaction with the metallurgy of the conductor arrays on which it is deposited. The expansion characteristics of the dielectric must be tailored to that of the associated substrate members 27 and 29 to prevent bowing, cracking or distortion of the substrate. As an overlay or a homogeneous film, the dielectric layers 33 and 35 are formed over the entire surface of the gaseous discharge device in the preferred embodiment of the instant invention rather than a cell-by-cell definition.

The nickel doped magnesium oxide overcoating the associated dielectric layers is shown in FIG. 2 as layers 39, 41 which, as previously noted, yield not only high bistable margins, but also provide a relative invariance of surface properties, namely, the secondary-electron emission characteristics under the discharge environment during normal panel operations. As in the dielectric layer with respect to the substrate, the overcoating layers 39 and 41 are required to adhere to the surface of the dielectric layers and remain stable under panel fabrication including the high temperature edge-sealing of the glass plates to form the gaseous discharge device and subsequent high temperature baking and evacuation processes associated with gas panel fabrication. A 3000 angstrom thick coating for the dielectric overcoat is used in the preferred embodiment. While the nickel doped magnesium oxide coating in the above-described preferred embodiment of the instant invention is applied over the entire surface of the dielectric, it will be appreciated that it could be also formed on a site-by-site definition.

The final parameter in the instant invention relates to the gas space or discharge gap 45 between the opposing nickel-magnesium oxide surfaces in which the gas is contained. This is a relatively critical parameter in the gas panel, since the intensity of the discharge and the interactions between discharges on adjacent discharge sites are function of, inter alia, the discharge gap. While the size of the gap is not shown to scale in the drawings in the interest of clarity, a spacing of approximately 3 to 5 mils is utilized between cell walls in the preferred embodiment. Since a uniform spacing distance must be maintained across the entire panel, suitable spacer means, if needed, could be utilized to maintain this uniform spacing. One example of appropriate spacer means is taught in the referenced copending application Ser. No. 841,186. While the gas is encapsulated in the envelope, additional details regarding edge-sealing of the glass plates or fabrication details such as the high temperature bakeout, evacuation and backfill steps have been omitted as beyond the scope and unnecessary for an understanding of the instant invention. However, details on these features are fully described in the aforereferenced U.S. Pat. No. 3,837,724. While the invention has been described in terms of a preferred embodiment of nickel doped magnesium oxide, it may also be implemented in other Group IIA oxides such as barium oxide, calcium oxide or strontium oxide, doped with one or more transition elements as heretofore described.

In conventional gas discharge panels having a layer of Group IIA oxide such as magnesium oxide on the gas interfacing surface, oxygen displacement from the discharge sites caused by ion bombardment during panel operation results in an increase in the secondary-electron emission coefficient of magnesium oxide and hence in a significant decrease in the maximum sustain voltage and the bistable voltage margin during panel operation, thereby significantly limiting the usable life of the panel. The incorporation of nickel or of nickel and/or chromium or manganese into the magnesium oxide stabilizes the secondary-electron emission coefficient of magnesium oxide under ion bombardment, thus virtually eliminating the decrease in the maximum sustain voltage and the bistable voltage margin during panel operation, therey significantly extending the panel life.

In summary, the incorporation of a beneficial amount of nickel, which may range from 3 to 5 weight percent, into the magnesium oxide dielectric overcoat of a plasma display panel stabilizes the secondary-electron emission coefficient of magnesium oxide under ion bombardment, resulting in virtually eliminating the decrease in the maximum sustain voltage and the bistable voltage margin during panel operation. For a given gas mixture and pressure and cell dimensions, the incorporation of beneficial amount of nickel into magnesium oxide causes the maximum sustain voltage to increase, while the minimum sustain voltage remains essentially unchanged, thereby enhancing the bistable voltage margin of the panel. The instant invention thus stabilizes the maximum and minimum sustain voltages, increases the bistable voltage margin of the panel and maintains the voltage margin during panel operation.

While the invention has been particularly shown and described with reference to preferred embodiments thereof, it will be understood by those skilled in the art that other changes in form and detail may be made therein without departing from the spirit and scope of the invention.

Having thus described my invention, what I claim as new, and desire to secure by Letters Patent is:

1. In a gaseous discharge display device characterized by an ionizable gaseous medium in a gas chamber formed by a pair of dielectric members having opposed wall charge storage, and at least one electrode insulated from said gaseous medium by said dielectric members, a dielectric protective overcoat formed over the gas contacting surfaces of said dielectric members, the improvement wherein the surface of said dielectric overcoats comprises material which provides refractory properties, high secondary emission characteristics, stable operating voltages and margins and extended life capabilities, said material being selected from a Group IIA oxide containing a predetermined concentration of 3% to 5% by weight of one or more transition elements selected from nickel, iron, manganese or chromium, said concentration of transition elements providing a predetermined amount of excess oxygen diffused in the surface of said Group IIA oxide to stabilize the secondary emission characteristics of said dielectric overcoat surface.

2. A device of the type claimed in claim 1 wherein said Group IIA oxide comprises magnesium oxide.

3. A device of the character claimed in claim 2 wherein said transition element is nickel having a concentration of 3 to 5 percent by weight relative to said magnesium oxide.

* * * * *